United States Patent [19]

Hurwitz et al.

[11] 4,245,614

[45] Jan. 20, 1981

[54] FIREPLACE SCREEN

[75] Inventors: Mathew Hurwitz, 63 Oakland Ave., Auburndale, Mass. 02166; Evelyn R. Hurwitz, Auburndale, Mass.

[73] Assignee: Mathew Hurwitz, Auburndale, Calif.

[21] Appl. No.: 941,554

[22] Filed: Sep. 12, 1978

[51] Int. Cl.[3] ..... F24C 15/36

[52] U.S. Cl. ..... 126/202; 49/410; 49/425

[58] Field of Search ..... 126/140, 202; 49/409, 49/410, 411, 425, 38

[56] References Cited

U.S. PATENT DOCUMENTS

| | | | |
|---|---|---|---|
| Re. 24,508 | 7/1958 | Grossman | 189/46 |
| 2,485,296 | 10/1949 | Lescaze | 49/410 X |
| 2,501,278 | 3/1950 | Hughes et al. | 126/202 |
| 2,619,205 | 11/1952 | Best et al. | 49/425 |
| 2,708,869 | 5/1955 | Grossenbacher et al. | 49/38 X |
| 2,776,707 | 1/1957 | Helwig | 160/118 |
| 2,841,218 | 7/1958 | Goodman | 160/118 |
| 2,850,772 | 9/1958 | Adcock | 49/409 |
| 2,895,183 | 7/1959 | Dumbolton | 49/410 X |
| 3,457,907 | 7/1969 | Brunig | 126/140 |
| 3,459,173 | 8/1969 | Lydle | 126/202 |
| 3,469,570 | 9/1969 | Wright | 126/202 |
| 3,653,157 | 4/1972 | Casebolt | 49/411 |
| 3,750,338 | 8/1973 | Lissarrague | 49/413 |
| 3,789,825 | 2/1974 | Reiner | 126/202 X |
| 3,913,558 | 10/1975 | Caldwell | 126/139 |
| 4,059,091 | 11/1977 | Cobb | 49/410 X |
| 4,102,321 | 7/1978 | Githens | 126/202 |

*Primary Examiner*—Stephen P. Garbe

*Attorney, Agent, or Firm*—Arnstein, Gluck, Weitzenfeld & Minow

[57] ABSTRACT

An improved glass panelled fireplace screen has sliding doors within a frame. The joints between the doors and the frame and between adjacent doors provide novel seals for effectively impeding the passage of air when the doors are in closed position. The screen includes thermostatically operated means which automatically opens the draft control when a fire is burning in the fireplace and which closes the draft control when the fire is out.

17 Claims, 16 Drawing Figures

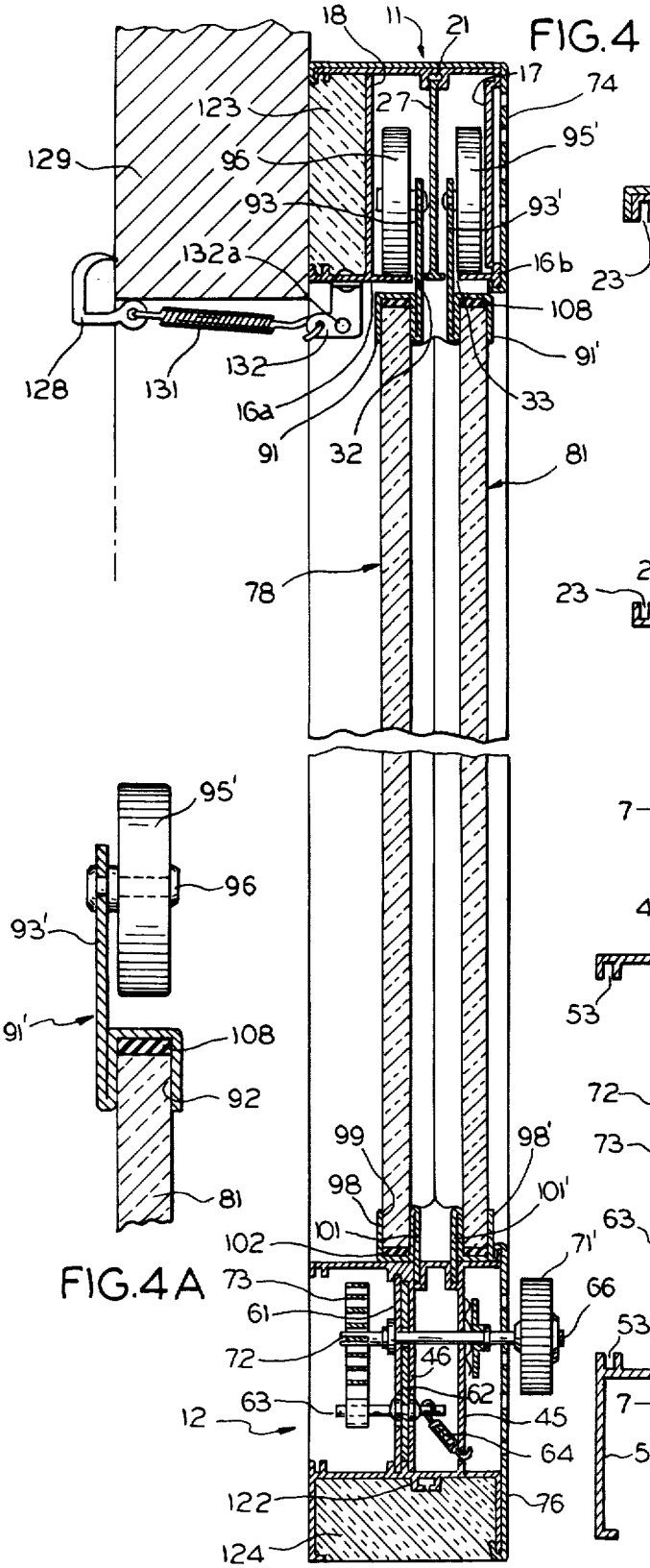
FIG.4
FIG.4A
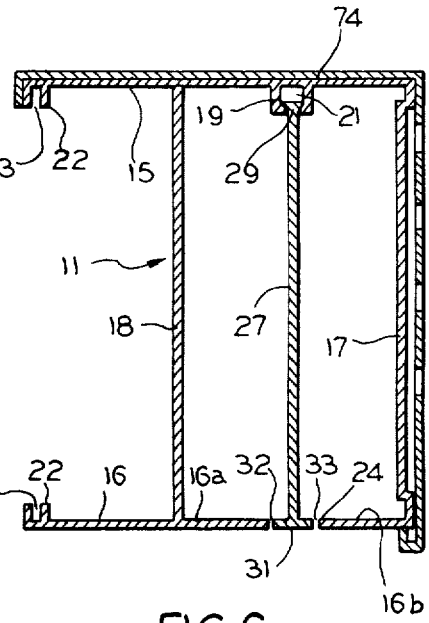
FIG.6
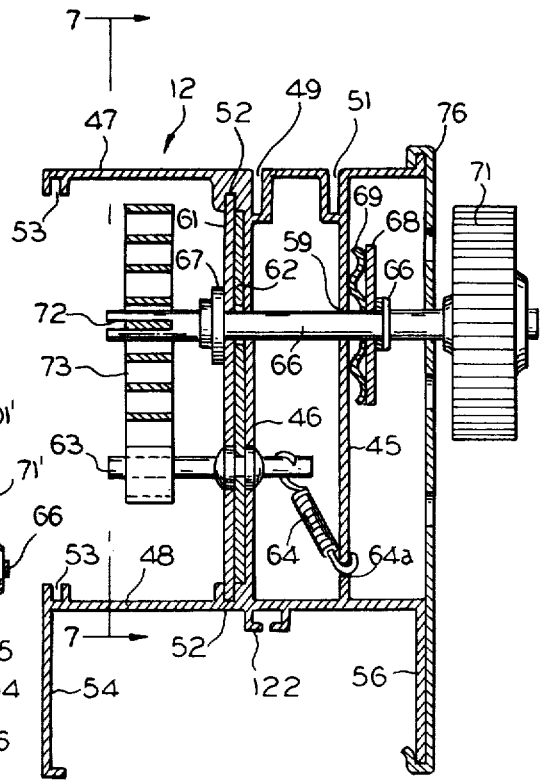
FIG.5

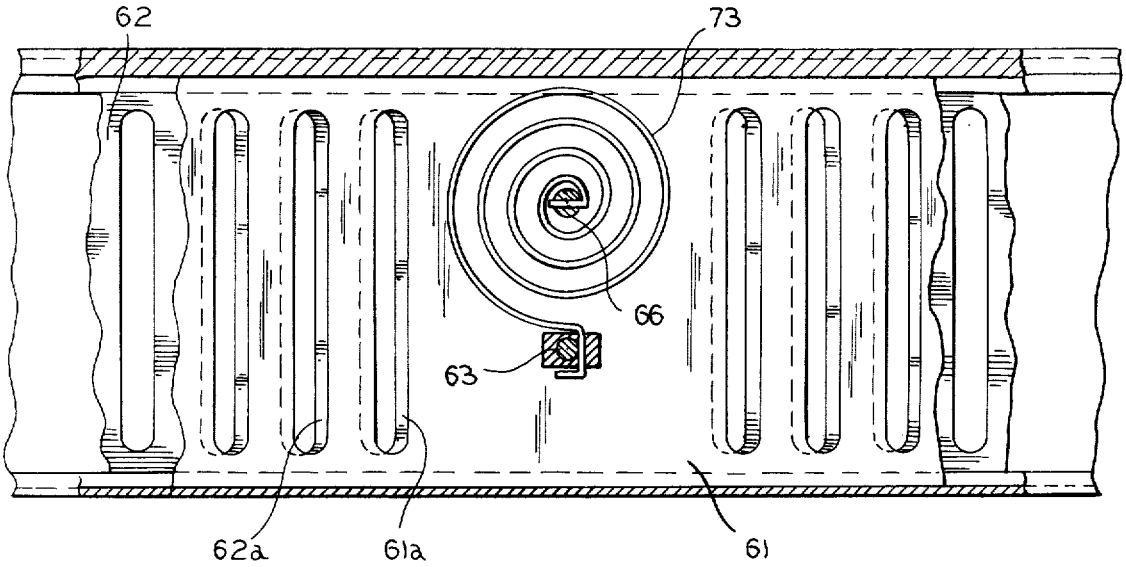
FIG.7
FIG.8
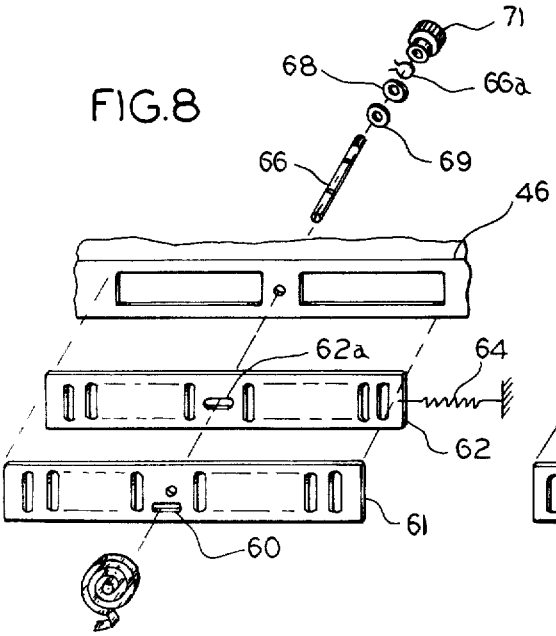
FIG.9
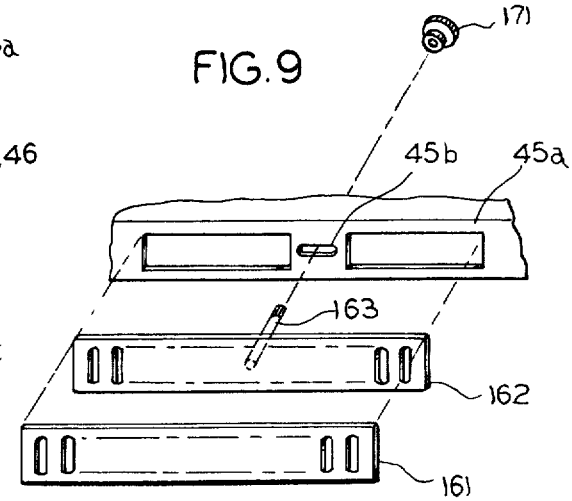

FIREPLACE SCREEN

BACKGROUND OF THE INVENTION

This invention relates to an improved glass panelled fireplace screen and more particularly to a screen which seals the fireplace opening to impede the passage of air so as to reduce very substantially the loss of warm room air up the chimney when the fireplace is not in use.

It is well known that most fireplaces have poorly closing dampers which provide little or no sealing effect. As a result, significant volumes of heated room air pass out of the house by way of the chimney when the fireplace is not in use. Typically, even under conditions of moderate outdoor wind velocity, it is not unusual for heated room air to escape via the fireplace chimney at a rate of 200 cubic feet per minute. For example, if the outside air temperature is 32° F. and the inside room temperature is 72° F., the escaping flow of room air carrier energy from the house at a rate in excess of 200,000 BTU per day. In a typical home having a furnace rated at 100,000 BTU/hr this energy loss must be made up by the furnace having to run more than two extra hours per day. The chimney loss becomes much worse during colder weather and/or when the wind velocity is high.

The marketplace provides glass panelled fireplace screens as means to reduce this loss of energy from the house. Conventional screens, however, do not seal a fireplace very efficiently. Such glass-panelled fireplace screens generally comprise a rectangular framed structure containing four panels of tempered, heat resistant glass which are hinged together in folding pairs, such that each bi-folding pair opens outwardly to provide access to one half of the fireplace opening. Because these so-called bi-fold screens are mass produced to sell at reasonable, competitive prices, the clearances between the panels and their frame structure must be large enough to take into account the substantial buildup of manufacturing tolerances in all their separate parts. As a consequence, even the best screens on the mass market have such wide gaps around the panels, when they are closed, that they provide only a 30% to 40% reduction in the wasteful loss of room air via the chimney.

A further problem with conventional fireplace screens lies in the primitiveness of their manual draft control mechanisms. Such screens generally utilize manually operated draft controls comprising a perforated, slideably moveable plate mounted within the bottom cross member of the frame, behind a stationary perforated plate. When the perforations of the two plates are in registry, the draft control is open permitting air to flow through to ventilate the fire. When the sliding plate is moved so that the perforations of the two plates are out of registry, the draft control is closed. In such condition the draft control is intended to prevent the loss of room air via the chimney, after the fire is out. Such draft controls have two inherent disadvantages: (1) the thin sheet metal sliding plates are guided only at their ends and do not lie flat against the stationary plate so that even when they are closed, these draft controls leak, and, (2) someone must remember to manually close the draft control.

SUMMARY OF THE INVENTION

The present invention combines certain well-known structures with certain novel elements to produce a novel combination of elements which provides a vastly improved fireplace screen having significantly greater sealing capability than prior art screens.

Accordingly, it is an object of this invention to provide an efficient sealing glass-panelled fireplace screen capable of reducing the loss of warm room air up the chimney by at least 90% when the fireplace is not in use.

Another object is to provide an efficient sealing fireplace screen which is economical to produce for sale to mass markets at a reasonable price.

A further object is to provide a glass-panelled fireplace screen whose aesthetics do not depart radically from those of existing conventional bi-folding screens which have gained wide acceptance in the marketplace.

Still another object is to provide an efficient sealing glass-panelled fireplace screen which utilizes no soft or delicate sealing members which would fail in use or exhibit a short useful life under the harsh thermal and mechanical conditions to which fireplace screens are frequently subject.

Still a further object is to provide an efficient sealing fireplace screen having a tightly closing draft control with automatic thermostatic means for closing the draft control when the fire dies out.

BRIEF DESCRIPTION OF THE DRAWINGS

FIG. 4 is a cross sectional view, on an enlarged scale, taken substantially on line 4—4 of FIG. 1, when the two panels on the left side are in contiguous relation.

FIG. 4A is a fragmentary cross sectional view of a detail shown in FIG. 4.

FIG. 5 is a cross sectional view, on an enlarged scale taken substantially on line 5—5 of FIG. 1.

FIG. 6 is a fragmentary cross sectional view, on an enlarged scale, only of the top horizontal member, taken substantially on line 6—6 of FIG. 1.

FIG. 7 is a fragmentary rear elevational view, on an enlarged scale, looking in the direction of the arrows 7—7 of FIG. 5 and illustrating the automatic draft control.

FIG. 8 is an exploded perspective view of the automatic draft control shown in FIG. 7; and FIG. 9 is a view similar to FIG. 8 but showing a manual draft control.

BRIEF DESCRIPTION OF A PREFERRED EMBODIMENT

Figure 1:
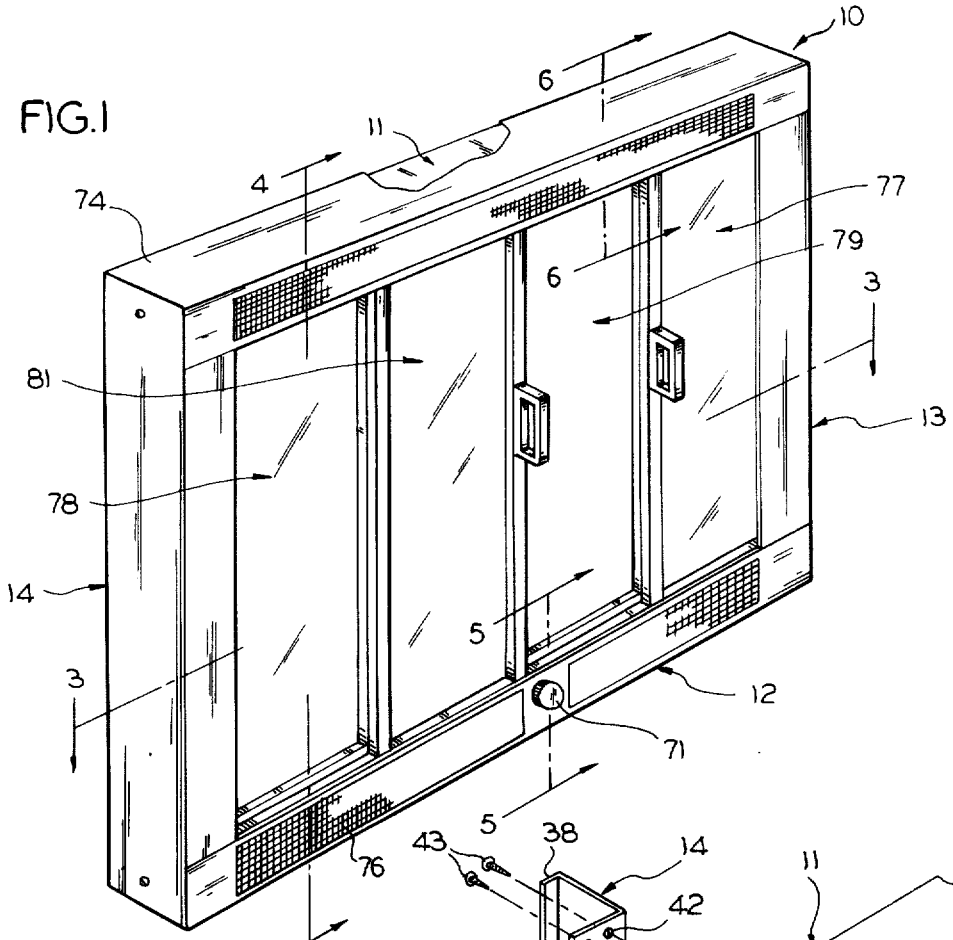
FIG. 1 is a perspective view of the fireplace screen assembly, in accordance with our invention, showing the screen panels on the right side in fully opened condition.
Figure 2A:
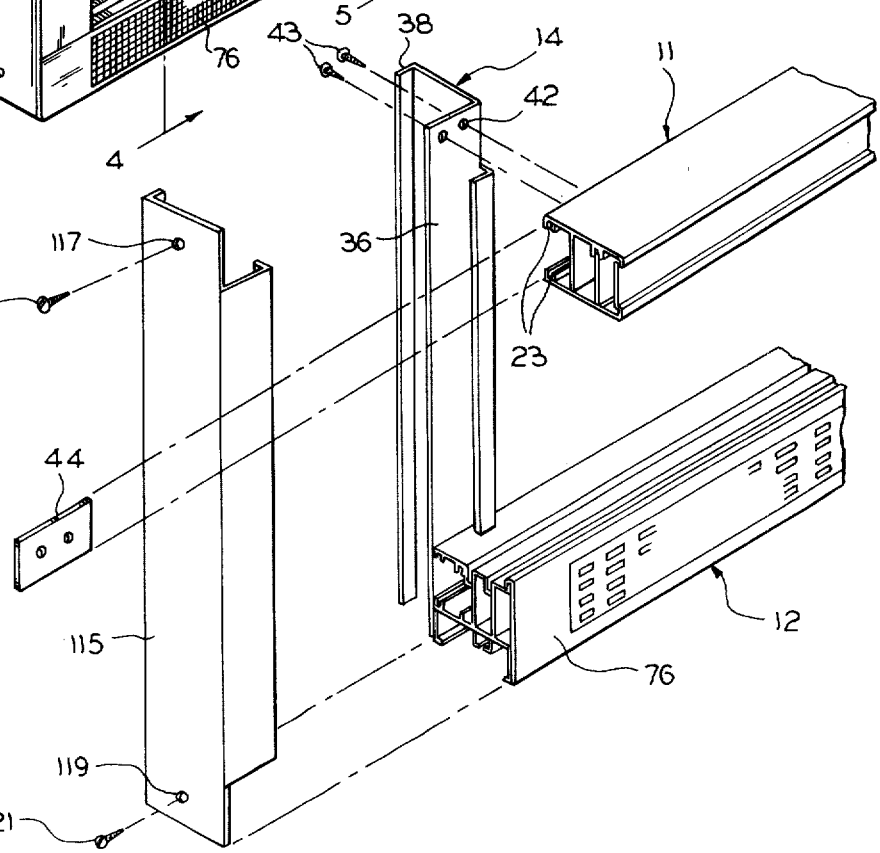
FIG. 2A is a fragmentary exploded perspective view, on an enlarged scale, of a portion of the screen shown in FIG. 1.
Figure 2:
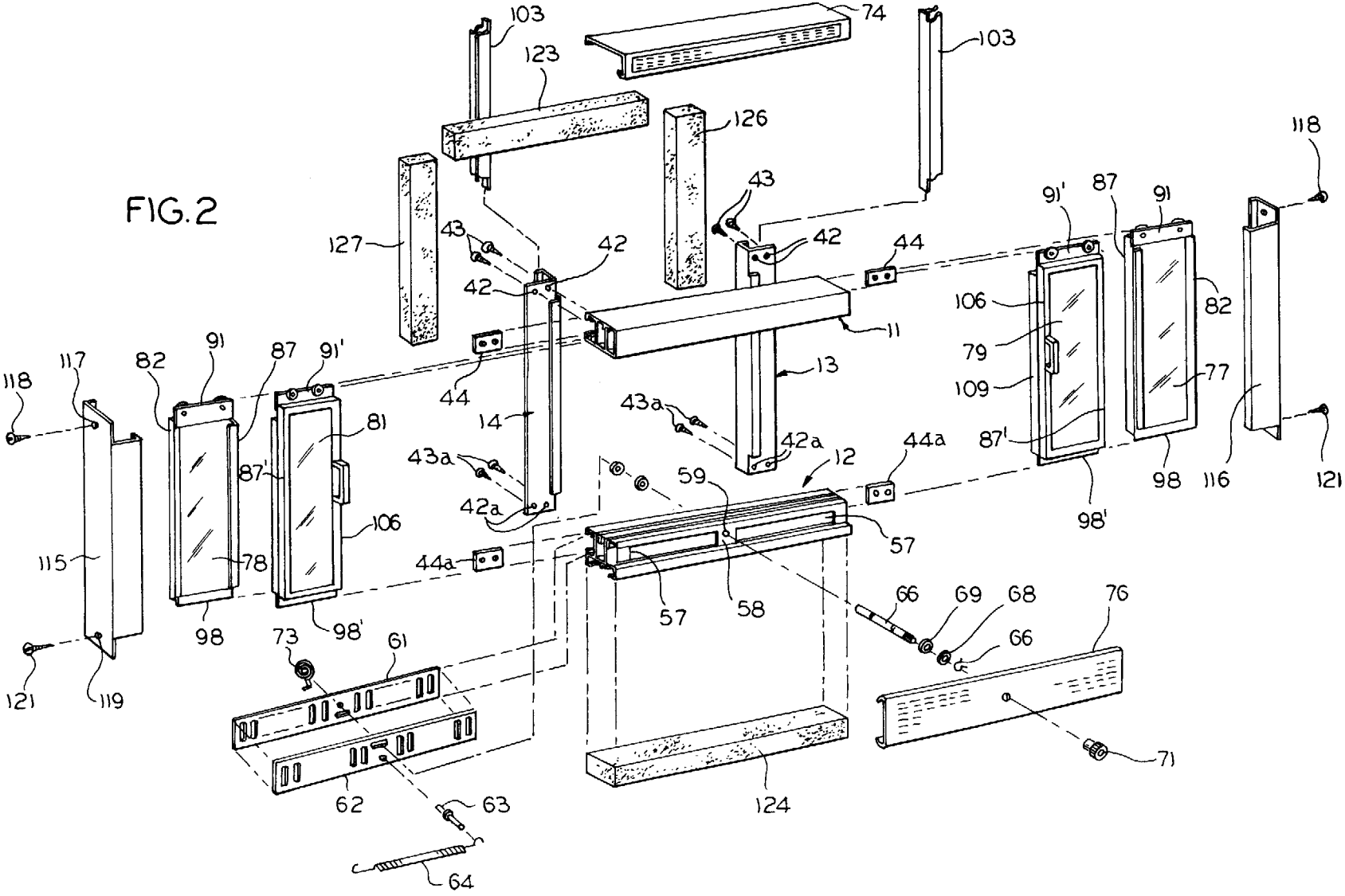
FIG. 2 is an exploded perspective view showing the relationship of the components comprising the assembly illustrated in FIG. 1.

The fireplace screen assembly 10 shown in FIGS. 1 and 2 comprises a rectangular main frame formed of an extruded aluminum top horizontal member 11, an extruded aluminum bottom horizontal member 12 and roll-formed steel right hand and left hand vertical members 13 and 14, respectively.

The upper member 11 is shaped in cross section as illustrated in FIG. 6 and includes top and bottom walls 15 and 16, respectively, a forward wall 17 and a rear wall 18, all integrally formed. The top wall 15 is provided with a depending longitudinally extending integral boss 19 having a longitudinally extending generally T-shaped slot 21. Each of the top and bottom walls 15 and 16 is provided along its rear longitudinal edge with a pair of spaced integral ribs 22 forming between each pair of ribs a longitudinally extending groove or channel 23, with the grooves 23 being in vertical registration. The bottom wall 16 is provided with a longitudinally extending opening 24 which is in vertical registration with the boss 19. The areas of wall 16 adjacent opening 24 constitute flanges or tracks **16*a* and 16*b* for supporting the door panels, hereinafter to be described. A panel 27 is formed with a generally T-shaped upper edge 29 which is received in the T-slot 21. The panel 27 depends from the boss 19 and is disposed in generally parallel relation to the front and rear walls 17 and 18, respectively. The lower edge of the panel 27 is provided with a longitudinally extending horizontal flange 31 which has less width than the opening 24 thereby providing a pair of parallel longitudinally extending narrow slots 32 and 33 along opposite edges of the flange 31**.

Figures 3, 3A, 3B, 3C, 3D, 3E, 3F:
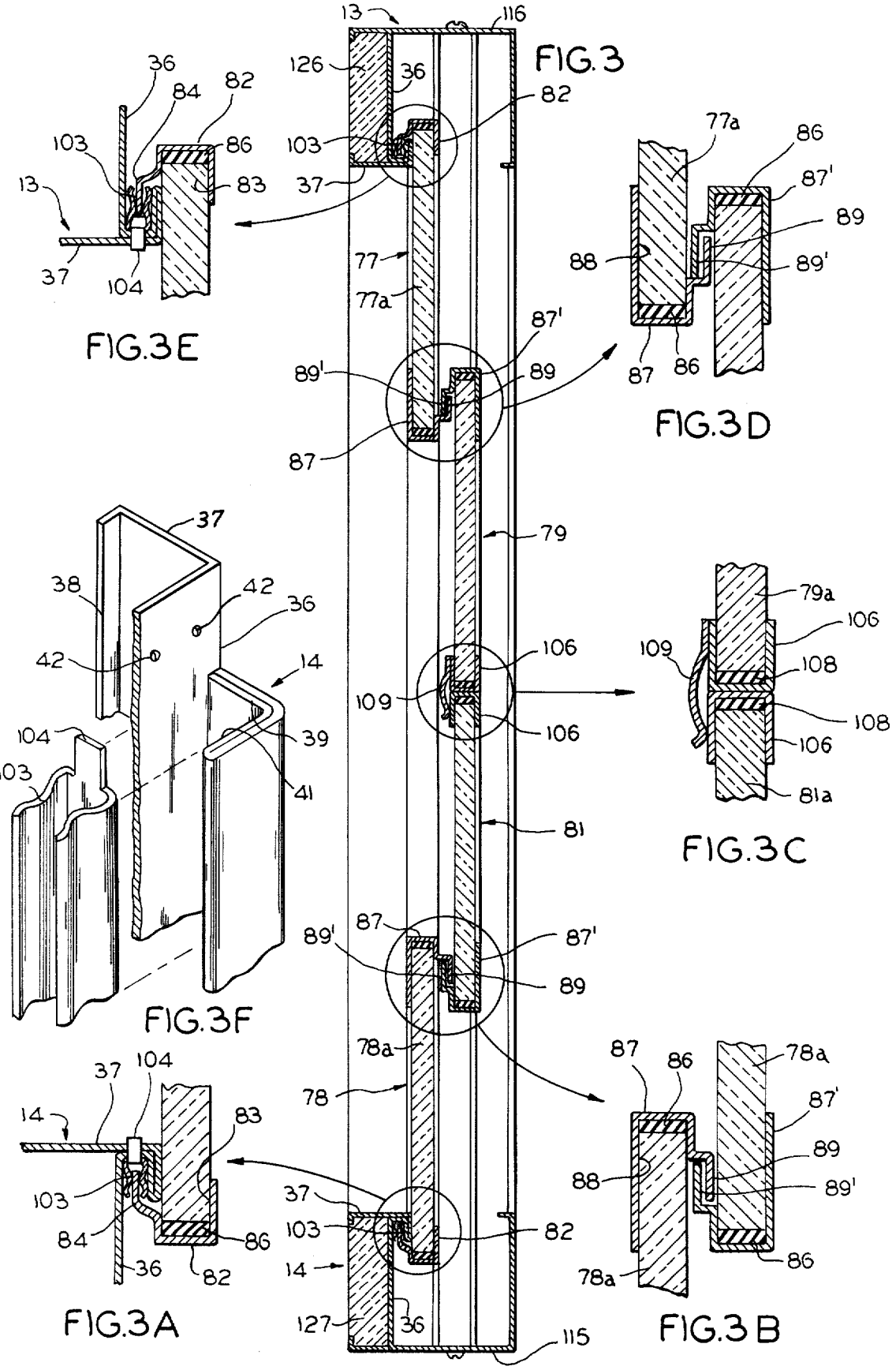
FIG. 3 is a cross sectional view, on an enlarged scale, taken substantially on line 3—3 of FIG. 1.
FIGS. 3A-3E are fragmentary cross sectional views, each on an enlarged scale, of details shown in FIG. 3.
FIG. 3F is a fragmentary perspective view, on an enlarged scale, of a detail shown in FIG. 3.

The upper member 11 is supported on the pair of vertical members 13 and 14 which are shaped substantially as illustrated in FIGS. 2, 2A and 3F. As will be noted in FIG. 2 the members are in allochiral relationship. Each member 13 and 14 is formed preferably of rolled sheet-metal and includes a front wall 36, a side wall 37 and a rear flange 38 all integral. Each vertical member 13,14 has an L-shaped extension 39 to provide a vertical recess 41 substantially rectangular in cross section. Portions of extension 39 are cut away at the top of each vertical member, as seen in FIG. 3F to provide clearances for assembly of each member to the top horizontal member 11. The front wall 36 of each vertical member is provided both at the top and bottom with a pair of holes 42 to receive sheet metal screws or blind rivets 43 which engage registering holes in backing plates 44 which are adapted to be slid into the registering grooves 23 of the horizontal member 11, as illustrated in FIG. 2A. Securement of the vertical members 13 and 14 to the horizontal member 11 is effected by tightening the sheet metal screws 43 which pass through holes 42 in the vertical members 13 and 14.

The lower horizontal member 12, similarly, is formed of extruded aluminum, shaped in cross section, substantially as illustrated in FIGS. 4 and 5, with a pair of spaced vertical webs 45 and 46 extending between the upper and lower walls, 47 and 48 respectively, and in spaced relation to each other. The upper wall 47 is provided with a pair of longitudinally extending recesses 49 and 51 opening upwardly and both the upper and the lower walls 47 and 48 are each provided with a groove 52 located adjacent to the vertical web 46 with said grooves being in registry. Also, the upper and lower walls 47 and 48 are each provided along the rearward edge with a recess 53, with said recesses being in registry. The lower member 12 is supported on a pair of integral longitudinally extending depending flanges 54 and 56. The lower member 12 is secured to the vertical members 13 and 14 substantially in the same manner as the upper member 11. Backing places **44*a* similar to plates 44, are slid into the grooves 53 and are engaged by sheet metal screws or blind rivets 43*a* passing through holes 42*a* in the vertical members 13 and 14. As seen in FIG. 2, both the forward and rearward webs 45 and 46 respectively, are provided with two elongated openings 57 separated by a narrow web portion 58 provided with an opening 59. A metal stationary plate 61 coextensive in length with the web 46 is inserted in the grooves 52 to become essentially a permanent part of the assembly of lower member 12. The stationary plate 61 has an array of perforations through which air may flow. A steel shutter plate 62 is slidably retained between the rear web 46 and the stationary plate 61** and has an array of perforations identical in geometry to the arry of perforations in the stationary plate. When the respective perforations are in registry, air will pass through the perforations and, when the perforations are out of registry, the passage of air is blocked.

The shutter plate 62 constitutes the draft control and its structure and function will be presently described in greater detaill. A pin 63 extends through an opening in the shutter plate 62 on opposite sides thereof and is permanently affixed to the plate, as by resistance welding or swaging. A tension spring 64 is anchored at one end to the pin 63 and at the other end in an opening **64*a* in the web 45. The spring normally biases the shutter plate 62 so that the perforations thereof are in registry with the perforations in the stationary plate 61 so that the shutter plate is in open condition permitting the free flow of air through. The stationary plate 61 is provided with a slot 60 through which pin 63 extends. The ends of slot 60 constitute abutments for limiting the longitudinal movement of the shutter plate 62**.

A control shaft 66 passes through registering holes 59 in the webs 45 and 46 and the plates 61 and through a slot **62*a* in shutter plate 62 and is secured in position by a snap ring 66*a* and washers 67 and 68. In addition to being secured in position the shaft 66 is provided with a spring-type thrust washer 69 to eliminate end play and to make the shaft turn stiffly in its supporting holes. A control knob 71 is secured to the forward end of the control shaft. The rearward end of the control shaft 66 is slotted as at 72 to receive the innermost turn of a bimetal spiral spring 73. The terminal portion of the outermost turn of the spring engages the rearward end of the pin 63. The bimetal spring 73 functions to urge the shutter plate 62 in a direction opposite the pull of the tension spring 64. The bimetal spring 73 is sufficiently stiff to overcome the tension of the spring 64 thereby to hold the shutter plate 62 in closed position when the control knob 71** is rotated to place the bimetal spring under sufficient stress. The operation of the draft control will be hereinafter explained.

As seen clearly in FIGS. 1 and 4, a decorative panel 74 is snapped on and is secured over the upper horizontal member 11 covering the top and forward wall of the member 11 and, similarly, another decorative panel 76 is snapped on and secured over the front of the lower horizontal member 12. These panels may be of thin gauge sheet metal and may be plated, embossed or filigreed as may be dictated by aesthetic and functional considerations.

Referring to FIGS. 3 and 4, the fireplace screen 10 includes two outer glass panels 77 and 78 and two inner panels 79 and 81, each fitted with a pane of heat resistant glass. Each of the two outer panels 77 and 78 is framed along its outermost edge by a vertical member 82 formed of thin gauge sheet steel rolled into the cross sectional configuration illustrated in FIGS. 3A and 3E. As seen in FIGS. 3, 3A and 3E, the frame members 82 are allochiral and each includes a channel section 83 and an offset rear lip 84. A glass pane *77a*, *78a* is received in the channel section 83 abutting a suitable gasket 86. Each panel 77 and 78 is framed along its innermost edge by a roll formed steel member 87, shaped substantially as illustrated in FIGS. 3B and 3D, and includes a channel section 88 and an offset forward lip 89. The opposite edge of the glass pane *77a*, *78a* is received in the channel section 88 and abutted against gasket 86. The top edge of each glass pane *77a* and *78a* is framed by a roll formed steel member 91, shaped substantially as illustrated in FIGS. 4 and 4A, and includes a channel section 92 opening downwardly and an upwardly extending flange 93. A gasket 94 is interposed between the upper edge of the pane *78a* and the bight of the channel 92. A pair of rollers 95 are mounted on a pair of pins 96 anchored in each of the flanges 93 and are disposed in vertical registry with the plane of the glass pane *78a*. The bottom of each panel 77 and 78 is framed by a thin gauge steel member 98 rolled to the configuration illustrated in FIG. 4 and includes a channel portion 99 in which the lower marginal edge of the glass pane *77a*, *78a* is received, and a depending vertical flange 101 which is slidably received within the groove 49 of the bottom frame member 12. A gasket 102 is interposed between panes *77a*, *78a* and member 98. As will be apparent by reference to FIG. 4, the rollers 95 ride on flange *16a* of the top frame member 11 to provide smooth horizontal travel of the panels across the mouth of the screen assembly. While adequate clearance must be provided in the slot 32 for the free movement of each flange 93 within the slot, it will be understood that any such clearance should be maintained at a minimum in order to minimize the passage of air therethrough from the room into the chimney flue. Correspondingly, minimum clearance is provided between the depending flange 101 and the groove 49 of the bottom frame member 12 in which the flange is received. The vertical and horizontal panel frame members 82 and 91, 98 respectively, are suitably secured together at the corners by screws or blind rivets or by other conventional means well known in the art.

As seen in FIGS. 3A, E and F, each of the vertical channels 39 of vertical members 13 and 14 is provided with a resilient, thin gauge metal insert 103 preferably of phosphor bronze rolled substantially to the configuration illustrated and substantially coextensive in height with the panels 77 and 78. As seen clearly in FIG. 3F, the legs of the insert 103 are generally S-shaped and allochiral to provide a constricted opening therebetween. The top and bottom ends of the insert 103 are provided with tabs 104 which are adapted to be bent over the corresponding edges of the vertical members 13 and 14 to secure the insert within the channel 39.

Each of the forward panels 79 and 81 is provided with a frame which includes a top member 91' which is identical to the member 91, hereinbefore described, but is reversely positioned, a bottom member 98' which is identical to the member 98, hereinbefore described, also reversely positioned, and two vertical members 87' and 106. The members 87' are identical to members 87 but reversely positioned. The members 106 are of channel configuration and engage the inner marginal edges of the panes *79a* and *81a* with gaskets 108 interposed as shown in FIG. 3C. One of the members 106 is provided with a resilient thin gauge metal lip 109 coextensive in length with the panel 79. The lip 109 preferably of steel overlaps the marginal edge of the panel 81 in sealing relation when the panels 79 and 81 are in closed position, as viewed in FIG. 3. As seen in FIG. 4, the rollers 95' are adapted to ride on the flange *16b* while the flange 101' is received in guide slot 51 of the lower frame member 12.

Referring to FIG. 2 the frame is assembled by securing the horizontal members 11 and 12 to the vertical members 13 and 14. The four sliding panels 77, 78 and 79, 81 are installed into the frame in pairs thusly. The forward left hand inner panel 81 is partially slid into the frame members 11 and 12 so that its vertical flange 93' is received in the narrow slot 33 of the upper frame member 11 with the rollers 95' riding on the flange *16b* and the depending flange 101' received in the channel 51 of the lower frame member 12. Before the panel 81 is fully slid into position and while its left hand portion is still protruding outside of the frame, the left hand outer panel 78 is interlocked with the panel 81 by interengaging the lips 89 and 89' and then sliding both panels as a unit to the right so that the vertical flange 93 is received in the narrow slot 32 of the upper frame member 11 with the roller 95 riding on flange *16a* and the depending flange 101 of the panel 78 being received in channel 49 of the lower frame member 12.

In a similar fashion, the panels 77 and 79 are assembled into the frame by inserting these panels from the right side of the frame. Thus, the panels 77 and 78 are supported and guided for coplanar movement, as are the panels 79 and 81.

The frame is closed at both sides with a pair of sheet metal cover members 115 and 116, shaped substantially as shown in FIGS. 2 and 2A. These cover members may be formed of thin gauge brass-plated steel to harmonize with the decor of the decorative panels 74 and 76. Each of the members 115 and 116 is provided with an upper hole 117 to receive a sheet metal screw 118 which engages in the end of the slot 21. Correspondingly, each of the members 115 and 116 is provided with a lower hole 119 to receive a screw 121 which is engaged in the end of an extruded tunnel 122 integrally with the lower frame member 12. In fully assembled relation the fireplace screen of our invention presents an aesthetically desirable finished appearance.

Installation of the fireplace screen in a typical fireplace opening is simplified and improved over prior similar screens. The main frame is sealed against the brick or stone face of the fireplace and hearth by four sealing strips of fiberglass batting. As seen in FIG. 4 a sealing strip 123 is contained within the cavity at the rear of upper frame member 11 while a sealing strip 124 is contained in the cavity in the lower portion of the lower frame member 12. Correspondingly, as seen in FIG. 3 sealing strips 126 and 127 are contained in the rear cavities of vertical frame members 13 and 14, respectively. The sealing strips 123, 126 and 127 abut the forward face of the fireplace while the sealing strip 124 abuts the hearth face of the fireplace. All of the sealing strips compress to serve effectively to prevent leakage of air between the main frame and the fireplace face.

Referring to FIG. 4, the fireplace screen of our invention is installed flush with the face of the fireplace and is held snugly in position by means of a pair of spaced mounting hooks 128 which engage the fireplace lintel 129. Each mounting hook 128 is connected to a spring 131 which is connected to a bracket 132 riveted to the bottom wall of the horizontal frame member 11. If desired, an optional wire mesh firescreen curtain of conventional construction (not shown) may be mounted by its curtain rod using the mounting holes 132*a* provided in the brackets 132. The spring loaded mounting means, hereinabove described, affords a simple and convenient means for the customer to install the screen with a minimum of skill and without the use of tools or the like.

When the panels 77, 78, 79 and 81 are in closed position each is substantially sealed against air leakage on all of its four edges. FIGS. 3, 3*a*, 3*b*, 3*c*, 3*d* and 3*e* clearly illustrate the three types of seals employed for preventing air leakage through the five vertical joints which are created when the panels are closed. The two outermost vertical seals illustrated in FIGS. 3*a* and 3*e* are made between the offset flanges 84 and the legs of the resilient thin-gauge metal inserts 103 which are enclosed within the channels 39 of the vertical frame members 13 and 14. As will be apparent by reference to FIGS. 3A and 3E, the resilient inserts 103 each snugly engage the opposite sides of the flanges 84. Also, the outer edge of each of the glass panes 77*a* and 78*a* is sealed in its respective channel 83 by a gasket 86.

The vertical seals between cooperating panels 77, 79 and 78, 81 are effected by engagement of the edge of one of the offset flanges 89 or 89' with a confronting surface of the opposite member 87 or 87'. Thus, as seen clearly in FIG. 3B the offset flange 89' has its edge abutting a confronting surface of the member 87. It will be understood that the edge of offset flange 89 may abut a confronting surface of the channel member 87'. Normal variations in manufacturing tolerances would generally dictate that only one such edge would be in engagement with a confronting surface at any one time.

The vertical seal between the inner edges of the panels 79 and 81 is effected by the resilient lip 109 which contacts the entire length of the member 106 as well as by abutment of members 106.

Each of the vertical seals above described is rugged and durable and will not distort or lose its sealing ability under the harsh thermal and mechanical conditions of the fireplace. They do not rely on precisely fitting components and therefore are economical to produce.

The horizontal seals of the fireplace screen of the present invention are illustrated clearly in FIG. 4. Each of the four doors has a vertical flange 93 or 93' which extend through narrow slots 32 and 33 respectively, of the upper horizontal member 11. Correspondingly, all four panels have depending flanges 101 or 101' which fit into channels 49 and 51 respectively, of the lower frame member 12. Typically, the sheet metal thickness of the vertical and depending flanges is 0.020 to 0.025 in. and the width of each of the respective slots 32, 33, 49, 51, is of the order of 0.030 to 0.035 in. Accordingly, in order to violate these seals air must pass through a very narrow clearance which may range from as low as 0.005 in. to no more than 0.015 in. While it is recognized that some air will pass through this narrow clearance, the rate of air leakage is very minimal. It will be apparent that like the vertical seals, the horizontal seals are rugged and durable and capable of withstanding harsh thermal and mechanical conditions of the fireplace.

OPERATION

The fireplace screen of the present invention may be used in much the same manner as prior bi-folding glass door screens. The panels 79 and 81 are moved sidewise to provide a central opening for the introduction of firewood or for the removal of ashes. When a fire is burning in the fireplace the panels may be kept either opened or closed, as desired by the user. The automatic self-closing draft control generally is adjusted initially, with the fireplace at room temperature, by rotating the control knob 71 so that the shutter plate 62 just closes the perforations of plate 61. In this condition of adjustment, the draft control subsequently will open as the heat of the fire causes the bimetallic spring 73 to lengthen and thereby to relax its tension. With the bimetallic spring relaxed, the spring 64 draws the shutter plate 62 to the extreme right of its travel, as viewed from behind in FIGS. 7 and 8, so that the perforations 61*a* and 62*a* are in registry to permit the free flow of air therethrough. This occurs whether the panels 79 and 81 are open or closed, so long as the fire is hot. It is noted that FIG. 8 shows an optional means for connecting spring 64 to shutter plate 62 for purposes of simplifying the illustration.

When the fire is no longer desired, no additional firewood is added and the panels 79 and 81 are moved to closed position. The fire will die down and as the fire burns itself out the bimetallic spring 73 will cool off and regain its initial tension thereby closing the draft control panel or shutter panel 62 to block the flow of air through the perforations 61*a* and 62*a*. The remaining fire will die out rather quickly for lack of air and it will be apparent that without further attention the fire is safely extinguished and the fireplace is very substantially sealed off. In this condition the flow of warm room air past the fireplace screen is very materially diminished, generally to less than 10% of the flow of air which would normally pass up the fireplace without the screen of the present invention. It will also be apparent that the presence of the fireplace screen prevents the entry of cold drafts and odors into the room resulting from chimney down drafts, a common problem with many fireplaces.

FIG. 9 illustrates a manual draft control in which the perforated shutter plate 162 is provided with a rigid shaft 163 which extends forwardly through an elongated slot 45*b* in the web 45*a*. A knob 171 is fixed on shaft 163 and may be engaged manually to slide the shutter plate 162 left and right to effect registry or non-registry of the perforations of the shutter plate 162 with those of stationary plate 161. Our invention contemplates the use of either the manual draft control or the automatic draft control, as options.

Various changes coming within the spirit of our invention may suggest themselves to those skilled in the art; hence, we do not wish to be limited to the specific embodiments shown and described or uses mentioned, but intend the same to be merely exemplary, the scope of our invention being limited only by the appended claims.

We claim:

1. A substantially air-tight glass door screen assembly for a fireplace opening, comprising (a) a rectangular frame adapted to be positioned in front of said opening, (b) said frame comprising a pair of spaced vertical frame members on opposite sides thereof, a top horizontal member having dual-track channels and extending between the upper ends of said vertical frame members with guide slots therein opening downwardly, a bottom horizontal member having dual-track channels and adapted to rest on the hearth of the fireplace and extending between the lower ends of said vertical frame members with guide slots therein opening upwardly, (c) a first pair of glass door panels mounted in a common plane coincident with the rearward track of each of the top and bottom channels, in proximity to the fireplace opening, (d) a second pair of co-planar glass door panels movably mounted in the forward track of each of the top and bottom channels and adapted for relative reciprocating movement with respect to said first pair of panels, said second pair of panels when selectively disposed in overlapping relation to respective adjacent panels of the first pair providing an opening in the central portion of the frame, said second pair of panels when selectively disposed in laterally offset relation to respective panels of the first pair and with the inner edges of the panels of the second pair in abutting relation to each other providing a substantially complete closure for the inner boundries of said frame, (e) metal sealing elements embracing the opposite vertical edges of each of said door panels between the top and bottom horizontal members, (f) a metal sealing flange on each of said vertical frame members cooperating with the outer sealing element on each of said first pair panels in the closed position of said panels over said opening, (g) said metal sealing elements and sealing flanges having portions offset in planes parallel to said panels to provide labryrinthine passages at the junctions of the panels and surrounding frames, to impede air leakage therebetween, and (h) sealing means interposed between the forward face of said fireplace and said frame to prevent air leakage from and into said fireplace opening.

2. The invention as defined in claim 1, wherein the glass panels of both pairs are of substantially equal size.

3. The invention as defined in claim 1 including draft control means in the bottom horizontal member and a thermally responsive actuating mechanism operatively connected to said draft control means.

4. The invention as defined in claim 3 in which the draft control means includes a transversely movable plate having air passages and the thermally responsive actuating mechanism includes a spiral bi-metallic spring and a control knob for adjustment of said spring.

5. The invention as set forth in claim 1, including bracket means affixed to said rectangular frame at the rear of the inner boundary thereof, an impaling hook for engaging the inner surface of the wall adjacent to the fireplace opening, and a resilient connection between said hook and bracket means adapted to press said frame tightly to the outer surface of said wall.

6. The invention as set forth in claim 5, wherein said bracket means is affixed to the bottom edge of said top horizontal member with the impaling hook adapted to engage the inner surface of the wall adjacent to the top of the fireplace opening therein.

7. A substantially air-tight glass door screen assembly for a fireplace opening, comprising (a) a rectangular frame adapted to be positioned in front of said opening, (b) said frame comprising a pair of spaced vertical frame members on opposite sides thereof, a top horizontal member having dual-track channels and extending between the upper ends of said frame members with the channels opening downwardly and each provided with a narrow slot, and a bottom horizontal member having dual-track channels and adapted to rest on the hearth of the fireplace and extending between the lower ends of said vertical frame members and having upwardly facing narrow slots in alignment with said first mentioned slots and of substantially comparable width, (c) a first pair of glass door panels mounted in a common plane coincident with the rearward track of each of the top and bottom horizontal members, in proximity to the fireplace opening, (d) a second pair of co-planar glass door panels movably mounted in the forward track of each of the top and bottom horizontal members and adapted for relative reciprocating movement with respect to said first pair of panels, said second pair of panels when selectively disposed in overlapping relation to respective adjacent panels of the first pair providing an opening in the central portion of the frame, said second pair of panels when selectively disposed in laterally offset relation to respective panels of the first pair and with the inner edges of the panels of the second pair in abutting relation to each other providing a substantially complete closure for the inner boundries of of said frame, (e) metal sealing elements embracing the opposite vertical edges of each of said door panels between the top and bottom horizontal members, (f) a metal sealing flange on each of said vertical frame members cooperating with the outer sealing element on each of said first pair of panels in the closed position of said panels over said opening, (g) said metal sealing elements and sealing flanges having portions offset in planes parallel to said door panels to provide labyrinthine passages at the junctions of the door panels and surrounding frames, to impede air leakage therebetween, (h) upper horizontal metal panel frame members each embracing the upper edge of each door panel and having a vertical flange extending upwardly through a respective slot in the top horizontal member, (i) bottom horizontal metal panel frame members each embracing the bottom edge of each panel and having a depending vertical flange received within a respective upwardly facing narrow slot of the bottom horizontal member, (j) each channel of the top horizontal member having a horizontal flange along the lower edge with the free edge thereof defining one edge of the narrow slot therein, and (k) roller means mounted on the upwardly extending vertical flanges of said upper panel frame members and adapted for rolling movement on respective horizontal flanges to facilitate the free movement of said door panels between their alternate positions within said rectangular frame.

8. The invention as defined in claim 7, wherein said roller means each comprises a pair of disk wheels mounted on axles carried on a vertical flange for support and rolling movement on a respective horizontal flange.

9. The invention as defined in claim 7 including fiberglass batting interposed between the forward face of the fireplace and said frame to prevent air leakage from and into said fireplace opening.

10. The invention as defined in claim 7, including a resilient metallic strip having an edge thereof affixed to the entire inner face of one of the juxtaposed vertical metal sealing elements of the second pair of panels, with the opposite edge of the strip terminating in a lip extending beyond said one element for tight contact with the inner face of said other sealing element when they are in close juxtaposition.

11. In a substantially air-tight glass door screen assembly for a fireplace having a hearth and a wall opening, (a) a rectangular frame having top and bottom members with spaced vertical side members adapted to be positioned in front of said opening, (b) sealing strips on the bottom of said bottom member and at the back of the top and side members, adapted to make close contact with the hearth and boundaries of said wall adjacent to said opening, (c) a pair of front and rear longitudinal guide tracks at the bottom of said top member with a slot adjacent to each track, (d) a pair of slotted tracks at the top of said bottom member in underlying alignment with the slots in the top member, and (e) a pair of longitudinally displaced framed glass panels suspended from each of said guide tracks with at least the front pair adapted for to-and-fro movement along the slot and slotted track in said top and bottom member.

12. The invention as defined in claim 11, wherein both pairs of framed glass panels are adapted for sliding movement along both slots and underlying slotted tracks.

13. The invention as defined in claim 11, including resilient connections between said rectangular frame and the interior of the wall adjacent to the fireplace opening for pressing said frame tightly against the front exterior of said wall.

14. The invention as defined in claim 11, including rollers at the top of said framed glass panels for easy rolling along said guide tracks.

15. The invention as defined in claim 11, including rollers at the top of said framed glass panels for easy rolling along said guide tracks, and a flange extending upwardly from the top of each glass frame and passing through the slot adjacent to the guide track for supporting the rollers for rotary movement on horizontal axes.

16. The invention as defined in claim 15, including a vertical depending flange extending downwardly from the bottom of each framed glass panel for travel with close clearance within said slotted track.

17. The invention as defined in claim 16, including vertical sealing strips along the vertical edges of said framed glass panels adapted for mutual interengagement when brought into contiguous relation.

* * * * *